United States Patent [19]

Dalton

[11] 3,985,470

[45] Oct. 12, 1976

[54] DUAL PRESSURE HYDRAULIC PUMP

[75] Inventor: Thomas B. Dalton, Muskegon, Mich.

[73] Assignee: Westran Corporation, Muskegon, Mich.

[22] Filed: Oct. 14, 1975

[21] Appl. No.: 622,166

Related U.S. Application Data

[63] Continuation-in-part of Ser. No. 421,217, Dec. 3, 1973, abandoned, which is a continuation-in-part of Ser. No. 160,614, July 8, 1971, Pat. No. 3,776,665.

[52] U.S. Cl. ..... 417/252; 417/286

[51] Int. Cl.[2] ..... FO4B 3/00

[58] Field of Search ..... 91/290; 417/252, 253, 417/268, 397, 286

[56] References Cited

UNITED STATES PATENTS

| | | | |
|---|---|---|---|
| 1,831,370 | 11/1931 | Slatcher | 91/290 |
| 2,036,464 | 4/1936 | Dodge | 91/290 |
| 2,820,415 | 1/1958 | Born | 417/252 |
| 2,850,981 | 9/1958 | Arp | 91/290 |
| 2,938,465 | 5/1960 | McFarland et al. | 417/253 |
| 3,177,782 | 4/1965 | Sampson | 92/255 |
| R12,599 | 1/1967 | Hill | 417/253 |

FOREIGN PATENTS OR APPLICATIONS

| | | | |
|---|---|---|---|
| 1,270,455 | 7/1961 | France | 91/290 |

*Primary Examiner*—William L. Freeh
*Attorney, Agent, or Firm*—Gifford, Chandler & Sheridan

[57] ABSTRACT

A device for pumping hydraulic fluid by means of an air driven reciprocating piston. Valve means control the motion of the piston and the pressure of the hydraulic fluid and an improved, two-piece, piston construction improves its practical machinability.

7 Claims, 6 Drawing Figures

Fig-1
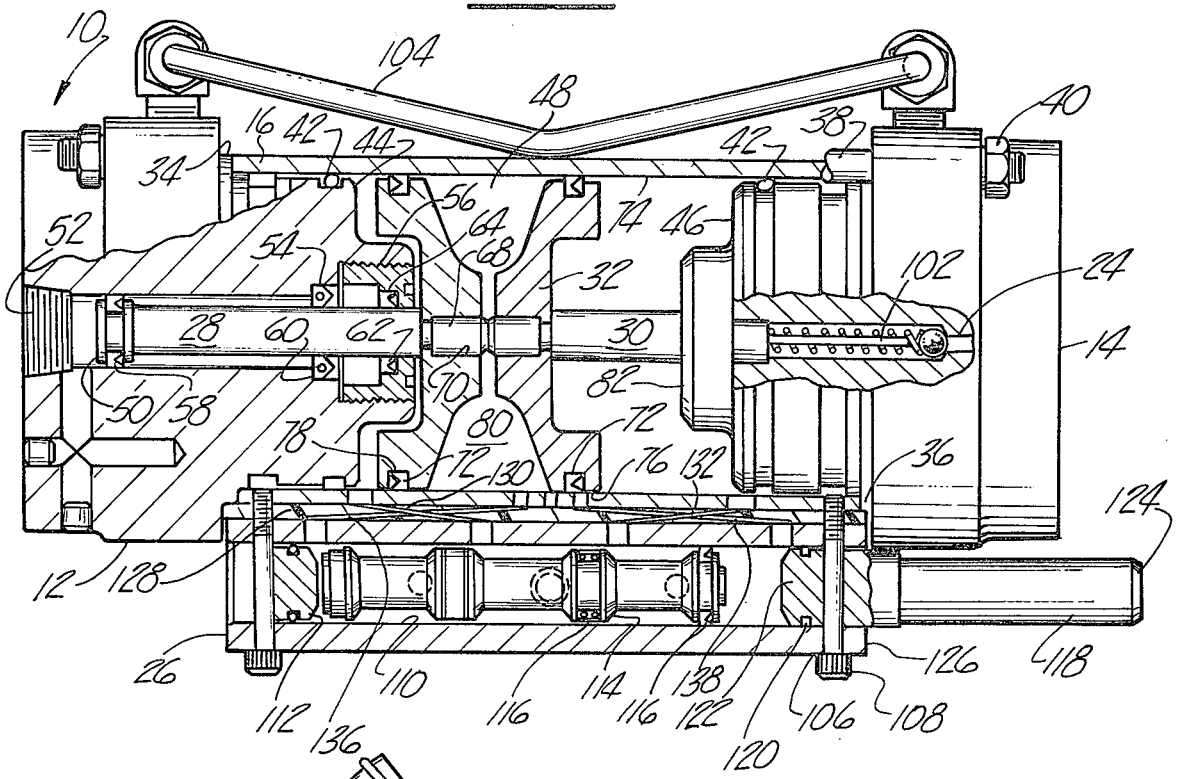
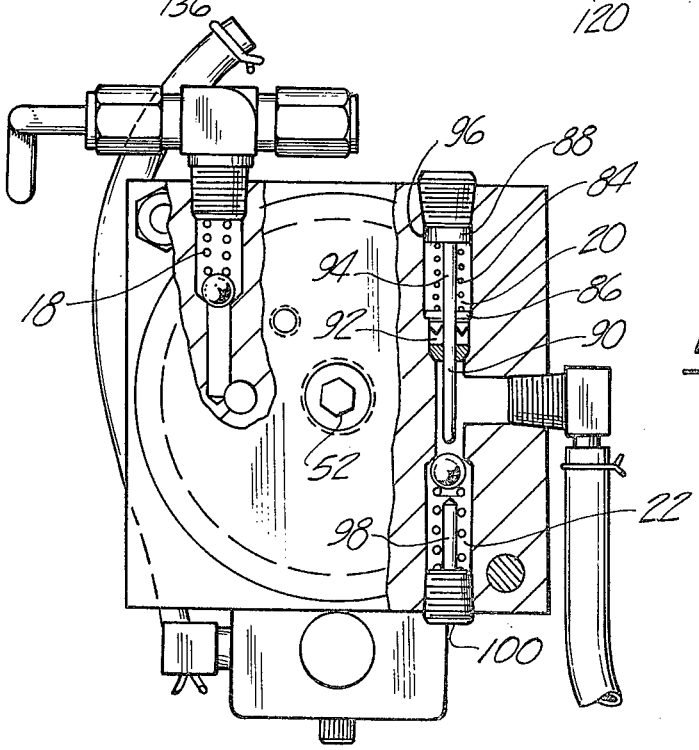
Fig-2

Fig-3
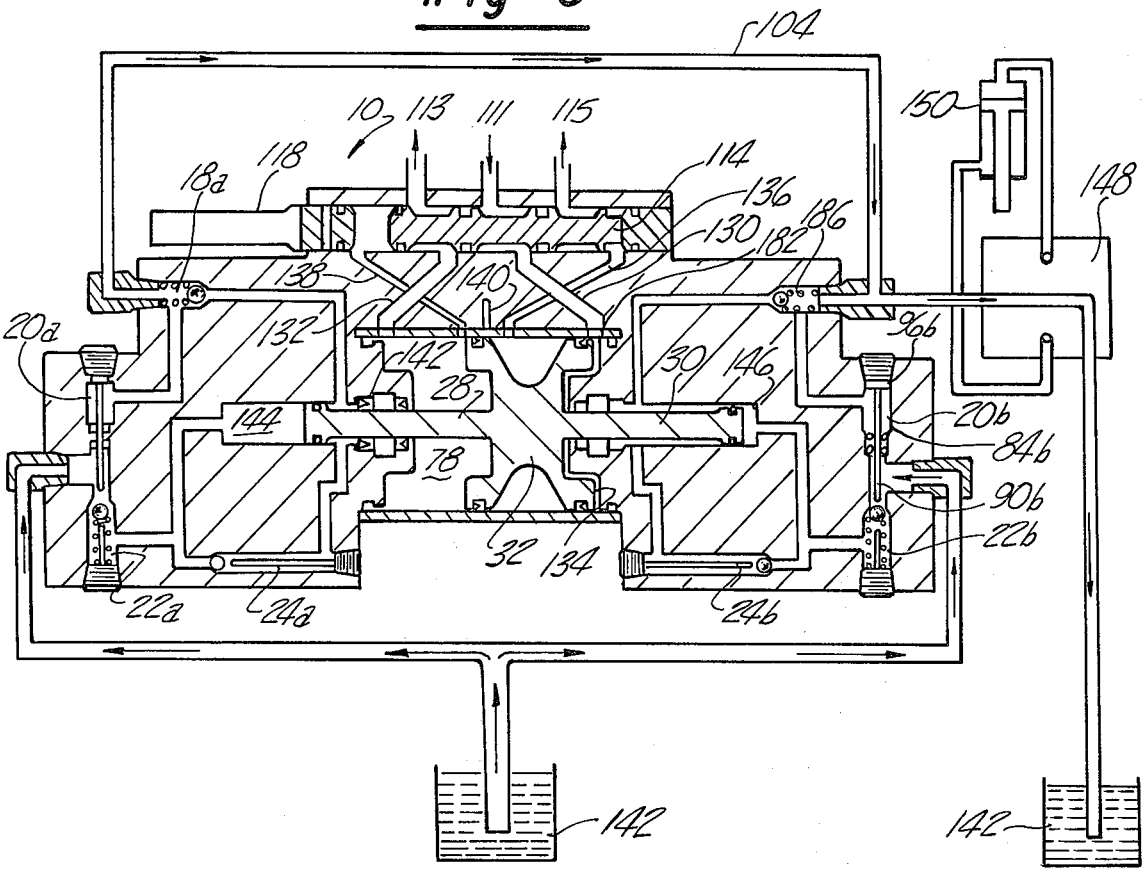
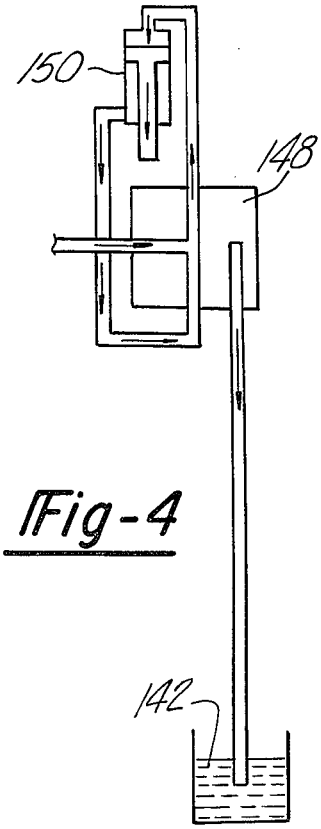
Fig-4
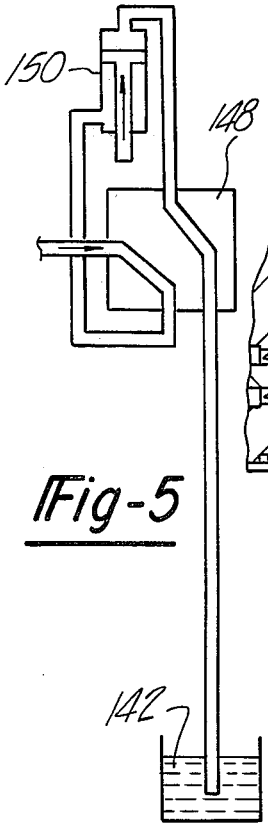
Fig-5
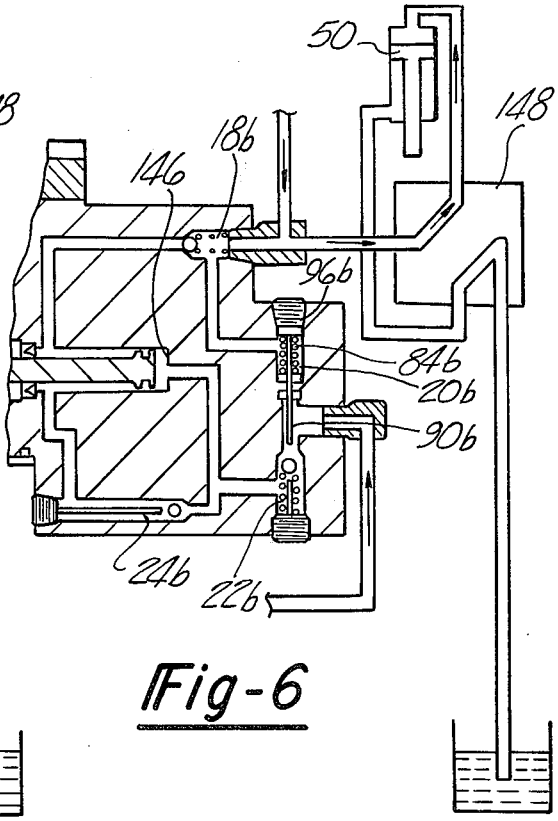
Fig-6

DUAL PRESSURE HYDRAULIC PUMP

RELATIONSHIP TO OTHER APPLICATIONS

The present application is a continuation-in-part of application Ser. No. 421,217 filed Dec. 3, 1973 and now abandoned which was a continuation-in-part of application Ser. No. 160,614 filed July 8, 1971 and now U.S. Pat. No. 3,776,665.

BACKGROUND OF THE INVENTION

I. Field of the Invention

The invention relates to hydraulic pumps in general and to positive displacement, air-hydraulic, reciprocating piston pumps with pressure controls in particular.

II. Description of the Prior Art

My aforementioned patent describes a new and improved double acting, air operated pump automatically operable to switch over from high volume-low pressure operation to low volume-high pressure operation upon a predetermined back pressure being produced.

The present invention provides an improvement over the construction disclosed in my aforementioned patent in that it describes a substantially simpler construction for such pumps. In my prior device, the hydraulic piston and the air piston were fashioned from a single piece of material. The concentricity requirements of such a construction make it expensive to produce. The present invention provides a construction in which it is easier and thus more economical to maintain the required relationship between the piston and their chambers.

DESCRIPTION OF THE DRAWINGS

These advantages and others will become obvious to those skilled in the hydraulic art upon reference to the accompanying specification and drawings in which like numerals refer to like parts throughout the several views and in which:

FIG. 1 is a partially sectional longitudinal view of the pump of the present invention taken in longitudinal profile showing its pumping mechanism and certain valve means;

FIG. 2 is another partially sectional view taken from the right end of the pump of the present invention as shown in FIG. 1;

FIG. 3 is a diagrammatic cross sectional view of the pump of the present invention as it is used in a typical hydraulic system employing a directional control valve and a hydraulic cylinder;

FIG. 4 is a diagrammatic view of the directional control valve and cylinder of FIG. 3 in a second position;

FIG. 5 is a diagrammatic view of the directional control valve and the cylinder in a third position; and FIG. 6 is a diagrammatic view of the directional control valve, the cylinder and a check valve of the present invention in another position.

DESCRIPTION OF THE PREFERRED EMBODIMENT

Referring now to FIGS. 1 and 2, the preferred hydraulic pump 10 is illustrated as comprising a first end housing 12, a second end housing 14, a central piston housing 16, two diametrically opposed hydraulic pistons 28 and 30, an air piston 32, hydraulic valve members 18, 20, 22, and 24 disposed in each of said end housings, and directional control air valve means 26 affixed to and in communication with said central piston housing. The end housings 12 and 14 are generally rectangular in cross section at their outer axial extremities, as may best be seen in FIG. 2, changing to a circular cross section and slidingly engaging the piston housing 16. The first housing 12 abuts the piston housing 16 at the flange surface 34, and the second housing 14 is provided with a similar raised flange portion 36 engaging and axially and radially retaining the piston housing 16, which is essentially cylindrical in external and internal configuration. Threaded rods 38 inserted in the end housings through holes (not shown) secured by nuts 40 secure the housings in the position shown. Sealing means 42 are disposed at the outer diameter of the cylindrical portions 44 and 46 of end housings 12 and 14, defining the ends of the air chamber 48 of the present invention.

The first hydraulic piston 28 and the second hydraulic piston 30 are similarly carried in first and second end housings 12 and 14 respectively. Each housing includes a central through bore 50 closed at its outer end by a threaded plug 52 or the like, a first counterbore 54 and a second, threaded counterbore 56, each concentric with the central through bore 50. The pistons 28 and 30 are generally cylindrical, having an enlarged end, grooved to carry suitable sealing means 48 for cooperation with the through bore 50. Direction sensitive dynamic sealing means 60 and 62 are disposed in directionally opposite axial orientation in the first counterbore 54 and a counterbore 64 of a threaded seal retaining member engaging the threaded bore 56 of the housing, respectively. These seal members isolate the air and hydraulic systems used with the pump of the present invention, sealing the reduced central section 66 of the oil pistons 28 and 30.

The other end of the pistons 28 and 30 is shown to comprise a portion 68 which is press fit into a bore 70 of the air piston 32.

The air piston 32 comprises two identical, substantially cylindrical portions, each including the central through bore 70 and sealing means 72 disposed at the outer diameter 74 cooperating with the inside diameter 76 of the piston housing 16 to divide the pump air chamber 48 into first 78, second 80, and third 82 subchambers.

Further, shown to be included inthe end housings are the valve members enumerated 18, 20, 22, and 24 in FIGS. 1 and 2 and having A and B suffix letters added in the diagrammatic views to differentiate between identical valves in different housings.

The first valve member 18 is a spring loaded ball check valve.

The second valve member 20 is a pressure sensitive dumping valve used to control third valve means 22. The dumping valve comprises a spring 84, a spring seat 86, and a piston 88 including a stem portion 90 that passes through the spring and slot into the third valve means and is sealed by appropriate sealing means 92. The piston 88 includes fluid conduits (not shown) whereby the pressures in the cavity 94 formed by one side of an enlarged end 96 of the piston and the sealing means 92 is transferred to the other side of the enlarged end 96 when movement of the piston opens the conduits.

The third valve means 22 is a spring loaded ball check valve situated in a bore coaxial with the second valve means 20 whose travel in the opening direction is limited by a retaining pin 98 formed on the end of a threaded plug 100.

The fourth valve member 24 is similar to the third valve means 22 and comprises a spring loaded ball check valve with a ball retaining pin 102.

In addition to the valve means described, fluid conduits 104 provide external fluid communication between the housings as will be better described below.

Mounted external to the piston housing 16 and adjacent to it is the directional control air valve 26. It comprises a generally rectangular housing 106, fixed to the piston housing 16 by means of screws 108 or the like, and having a central through bore 110 and air pressure and return ports 111, 113, and 115 (FIG. 3) formed therein, a sealing plug 112, a four landed cylindrical spool member 114 having dynamic sealing means 116 disposed thereon slidingly engaging the through bore 110, and a positioning piston 118 having dynamic sealing means 120 disposed proximate the inner end 122 thereof and havings its opposite end 124 extending beyond the corresponding end 126 of the housing 106, its outward travel being limited by mechanical stopping means not shown.

Disposed intermediate the air valve housing 106 and the piston housing 16 is a seal member 128 having passages therethrough that serve to transfer air between the air valve 26 and the piston chamber 48 as will be described in greater detail below.

While the merits of the construction used, that is, the integration of the hydraulic and pneumatic components in the structure described and the use of a two piece air piston design to reduce the burden of providing concentric oil and air cylinder bores, the unique approach used in this pumping device can best be presented through a discussion of its operation as illustrated in FIGS. 3 through 6.

Referring now to FIG. 2 low pressure operation of the preferred hydraulic pump 10 is initiated by manually shifting the spool member 114 fully inward (to the right in FIG. 3) by pushing in the positioning piston 118. The positioning piston 118 is then withdrawn to the position shown.

Referring to FIGS. 1 and 2, air at some elevated pressure, typically 80 psi in industrial situations, is introduced at the air supply port 111 and is directed to the third subchamber 82 through a conduit 130 at the right of the air piston 32, moving it to the left. Unpressurized air is exhausted from the first subchamber 78 through a conduit 132 to first air exhaust port 113 until the right end 134 of piston 32 opens conduit 136 through which pressurized air is directed to the right end of the spool member 114 driving it to the left, since the left end is connected to exhaust through conduits 138 and 140. As can best be seen in FIG. 1, the passageways 130, 132, 136, and 138 illustrated only diagrammatically in FIG. 3, are formed through the seal member 128. With the spool member 114 shuttled to the left hand position, pressurized air is directed to the first subchamber 78 and the air piston 32 is moved to the right, reversing the above described process. This reciprocating motion of the air piston 32 will continue until the air supply is removed or until the spool member 114 is mechanically prevented from shuttling as required.

Still referring to FIG. 3, it can be seen that the reciprocation of the air piston 32 is used to do work on a hydraulic fluid, pressurizing it to the extent required by the demands of the using system. In the position shown, the air piston 32 can be treated, for the purpose of analyzing the valve functions, as having just completed its rightward stroke. During this stroke high volume - low pressure oil is supplied from a reservoir 142. On the left hand side it is supplied to a point upstream from the valve member 22A, opening it and filling the cylinder 144 of firt oil piston 28. Restrictions (not shown) in the opposite end of the pumping system raise the pressure in the second pressure chamber or cylinder 146 adjacent second oil piston 30. The movement of this pressurized oil produced by the rightward movement of piston 32 opens valve members 24B and 18B while closing valve member 22B. With a directional control valve 148 in the position shown, fluid is directed to the reservoir 142 at low pressure. As the piston 32 reverses it travel he valve positions described reverse; but flow through the directional valve 148 continues.

Work may be done with the pressurized fluid to either extend or retract a cylinder 150 as shown in FIGS. 4 and 5 respectively. These functions are performed with the hydraulic pump 10 operating in the manner indicated in FIG. 3 where loads are such that high volume - low pressure operation is required.

Where higher pressure operation is needed the limitations on air power supply available may necessitate a reduction in pump outlet flow. The way in which this is accomplished in the preferred hydraulic pump 10 may best be seen by reference to FIG. 6. Here the piston 32 has completed its rightward travel and the cavity 146 about piston 28 is pressurized, valve member 18B is open, and the piston 88B of valve member 20B is sensing the high pressure. This depresses the spring 84B and shifts stem portion 90B downward upsetting the ball 150B of valve member 22B and opens the cylinder 146 to return. Reversal of the piston motion reverses this valve operation.

It is apparent that an invention has been described which is a considerable improvement over the construction of my aforementioned patent. The manufacture of reciprocating piston pumps is complicated by the necessity of holding relatively large air piston bore diameters concentric with the oil piston bores over a relatively large axial length. The two piece air piston and oil piston construction of the present invention alleviates these problems by allowing the two ends of the pump to be somewhat independent and self-centering.

I claim:

1. A fluid pump adapted to be driven by a pressurized fluid, said fluid pump comprising:

a housing having a bore separated on opposite sides into first and second, cylindrically formed, axially spaced pressure chambers, piston means carried in said bore and having cylindrical portions at each end extending into said chambers;

means for reciprocating said piston means;

a first port means for each of said first pressure chambers and respectively communicating said first pressure chambers to a source of fluid;

a second port means for respectively exhausting said first pressure chambers;

valve means normally closing communication between said first pressure chambers and their associated second port means;

outlet port means communicating with said first and second pressure chambers;

means responsive to a predetermined outlet pressure to actuate said valve means to open communication between said first chambers and said second port whereby fluid in said first chamber is exhausted through said second port means and fluid is thereafter delivered to said outlet port means only from said second pressure chamber;

said means for reciprocating said piston means comprising a piston having a pressure responsive area substantially exceeding the effective area of each of said piston means, said piston and said piston means being detachably mounted together and being reciprocally mounted in said housing on a coextensive axis, means for automatically supplying the pressurized gas to opposite sides of said piston to reciprocate said piston means;

said last mentioned means comprising a source of pressurized gas; a shuttle valve connected with said source of pressurized gas and operable in a first position to direct pressurized gas to one side of said piston and to exhaust the opposite side of said piston, and in a second position to exhaust and first mentioned side of said piston and to direct pressurized gas to the opposite of said piston;

valve means automatically moving said shuttle valve between said first position and said second position to automatically reciprocate said piston; and a seal member disposed intermediate said piston and said shuttle valve and passages provided through said seal member to operably connect said shuttle valve and said piston.

2. The pump as defined in claim 1, and in which said valve means comprises means delivering pressurized gas from the sides of said piston to the ends of said shuttle valve in response to said piston being moved to limit positions in each direction.

3. The pump defined in claim 1, wherein said valve means comprises:

a bore in said housing said first pressure chamber with said exhaust port means, a valve seat formed at one end of said bore;

a valve member resiliently biased into engagement said seat to normally close communication from said first pressure chamber through said bore passageway;

said actuating means comprises:

a second bore in said housing having a rod slidably mounted therein;

said rod projecting toward said valve means;

means communicating the pressure fluid within said second pressure chamber to the end of said rod whereby said rod engages said second valve member to unseat the same when the pressure in said second pressure chamber exceeds said predetermined amount to thereby exhaust said pressure chamber.

4. The fluid pump as defined in claim 1, and in which the effective volume of said first pressure chamber exceeds the effective volume of said second pressure chamber.

5. The fluid pump as defined in claim 1, and in which said second pressure chamber is a coaxial extension of said first pressure chamber.

6. The fluid pump as defined in claim 1, and in which said piston comprises two axially separable members, each of said members having a threaded recess and said piston means comprises cylindrical members received in said threaded recesses and extending axially therefrom in opposite directions.

7. The fluid pump as defined in claim 1, and including an extension of said shuttle valve extending exteriorly of said pump to permit manual positioning of said shuttle valve.

* * * * *

UNITED STATES PATENT AND TRADEMARK OFFICE

CERTIFICATE OF CORRECTION

PATENT NO. : 3,985,470
DATED : Oct. 12, 1976
INVENTOR(S) : Thomas B. Dalton

It is certified that error appears in the above-identified patent and that said Letters Patent are hereby corrected as shown below:

Col. 2, line 45, insert a space between "in the".

Col. 3, line 18, delete "havings" and insert --having--.

Col. 4, line 5, delete "firt" and insert --first--

Col. 4, line 14, delete "it" and insert --its--; delete "he" and insert --the--

Col. 5, line 20, second occurrence, delete "and" insert --said--

Signed and Sealed this

Fourth Day of January 1977

[SEAL]

*Attest:*

RUTH C. MASON
*Attesting Officer*

C. MARSHALL DANN
*Commissioner of Patents and Trademarks*